US005630478A

United States Patent [19]

Schimke

[11] Patent Number: 5,630,478

[45] Date of Patent: May 20, 1997

[54] MASONRY DRILL BIT AND METHOD OF MAKING A MASONRY DRILL BIT

[75] Inventor: Thomas O. Schimke, Louisville, Ky.

[73] Assignee: Credo Tool Company, Woodburn, Oreg.

[21] Appl. No.: 545,272

[22] Filed: Oct. 19, 1995

Related U.S. Application Data

[63] Continuation-in-part of Ser. No. 475,034, Jun. 7, 1995, abandoned.

[51] Int. Cl.[6] ..... E21B 10/44; E21B 10/58

[52] U.S. Cl. ..... 175/420.1; 76/108.6; 175/435

[58] Field of Search ..... 175/420.1, 427, 175/394, 435, 395; 76/108.2, 108.4, 108.6

[56] References Cited

U.S. PATENT DOCUMENTS

| | | | |
|---|---|---|---|
| 735,845 | 8/1903 | Vanderbeek . | |
| 2,614,813 | 10/1952 | Shepherd | 175/420.1 |
| 2,707,619 | 5/1955 | Andersson | 175/435 |
| 2,784,943 | 3/1957 | Bylund | 175/420.1 |
| 2,851,771 | 9/1958 | Pottmeyer | 29/471.1 |
| 2,902,260 | 7/1959 | Tilden . | |
| 3,290,772 | 12/1966 | Crouch | 29/493 |
| 3,434,552 | 3/1969 | Bower, Jr. | 175/420.1 |
| 3,447,616 | 6/1969 | Granat | 175/394 |
| 3,718,067 | 2/1973 | Fischer | 175/394 |
| 4,257,307 | 3/1981 | Regensburger | 411/387 |
| 4,314,616 | 2/1982 | Rauckhorst et al. | 175/394 |
| 4,433,739 | 2/1984 | Sarin | 175/418 X |
| 4,527,638 | 7/1985 | Sanchez et al. | 175/420.1 X |
| 4,579,180 | 4/1986 | Peetz et al. | 175/394 |
| 4,633,959 | 1/1987 | Knox | 175/418 X |
| 4,817,743 | 4/1989 | Greenfield | 175/427 |
| 4,883,217 | 11/1989 | Dunn et al. | 228/122 |
| 5,287,937 | 2/1994 | Sollami et al. | 175/427 |

FOREIGN PATENT DOCUMENTS

| | | | |
|---|---|---|---|
| 143937 | 9/1990 | Germany | 175/420.1 |

*Primary Examiner*—Hoang C. Dang
*Attorney, Agent, or Firm*—Middleton & Reutlinger; John F. Salazar

[57] ABSTRACT

A masonry drill and method of manufacture is disclosed. The drill has an elongated axial body with at least one discharge groove and a transverse slot located at one end with a hardened drill bit insert brazed within the slot. The hardened insert has projections extending outward from flat planar surfaces which hold the insert in proper orientation within the axial drill body so that it may be brazed into place subsequent to insertion into the drill body.

13 Claims, 1 Drawing Sheet

MASONRY DRILL BIT AND METHOD OF MAKING A MASONRY DRILL BIT

This Application is a continuation in part of application Ser. No. 08/475,034, filed Jun. 7th, 1995, now abandoned.

BACKGROUND OF THE INVENTION

1. Field of the Invention

The present invention relates to a masonry drill bit and particularly a masonry drill bit which has a drill body of a soft metal and a hardened carbide masonry drill bit insert inserted into the working end of said drill body.

2. Discussion of the Prior Art

Carbide-tipped masonry drills are fairly well known. A bit manufactured of tungsten carbide or other hardened material is inserted into a slot in the working end of a metallic shank, held in place utilizing a paste or other material which is replaced when the carbide insert is brazed within the slot. This practice, however, is very inaccurate in that the carbide insert is not oriented within the slot accurately and also prevents a clean braze. U.S. Pat. No. 3,447,616 teaches a drill having a detachable blade mounted on the end thereof in a slot extending transversely to the body of the drill. The blade is constructed with a hub having portions on opposite faces of the blade which fits into an opening formed into said slot so that the blade is oriented properly within the slot. U.S. Pat. No. 4,314,616 teaches a die-cast masonry drill with leading hard insert. The hardened insert is placed into the dies within which the drill body is to be cast. The drill body is cast in place around the insert with the molten material substantially surrounding the insert as well as interlocking means located on said insert. The insert is held into place within said slot by the contraction of the metal of the drill body due to differences in rates of thermal expansion.

SUMMARY OF THE INVENTION

The present invention is for a method and apparatus for a masonry drill bit having a carbide insert. The drill bit of the present invention is comprised of an elongated cylindrical body with a transverse slot at the working end. A hardened carbide insert having projections extending from each side is pressed within said slot to hold the carbide insert in place for proper brazing.

More particularly, the present invention comprises cylindrical drill body which has at least one discharge spiral groove extending along the axial length of said body to the shank of the drill body. The top of said drill body opposite the shank has a transverse slot which receives a hardened drill bit insert. The hardened insert is comprised of a leading cutting portion having two opposing cutting edges. The insert has first and second planar surfaces. Located on each of said planar surfaces are means for properly orienting and retaining the insert within the transverse slot. The means for retaining the insert within the slot is comprised of projections extending outward from each planar surface an equal distance over the projections entire length. These projections allow for braze material to enter between the hardened insert and the transverse slot and securely affix said insert within said slot.

Finally, the present invention comprises an elongated cylindrical drill body having at one distal end a transverse slot extending thereacross and a shank at the opposite distal end, said drill body having at least one spiral groove formed along its exterior surface from said transverse slot to said shank; a drill bit insert brazed within said transverse slot, said insert having: a bottom surface; a first and second parallel planar surface; a first and second side face connecting said first and second planar surfaces; a leading crown tip forming a first and a second upper surface extending downward from said crown tip to said first and second side faces; a first and a second cutting edge formed along opposite sides of said first and second upper surfaces; at least one projection extending vertically on each of said first and said second planar surface; and, a braze fill in the joint between said insert and said transverse slot.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
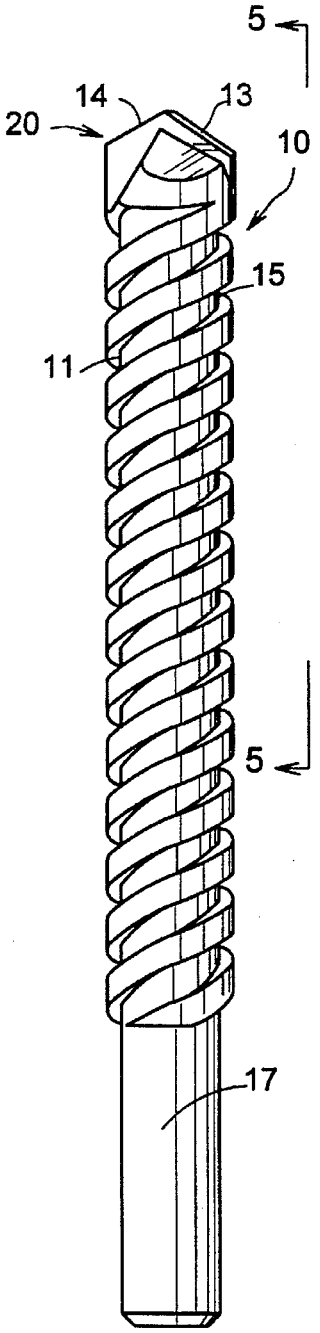
FIG. 1 is a frontal view of the assembled drill bit of the present invention.
Figure 5:
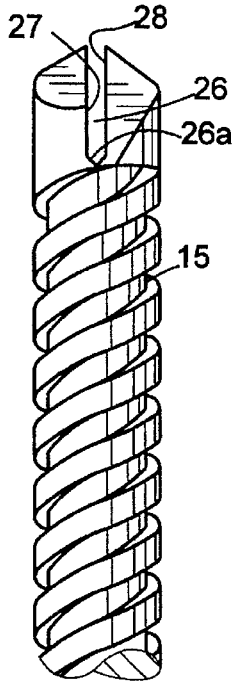
FIG. 5 is a perspective view of the cylindrical drill body of the present invention.
Figure 6:
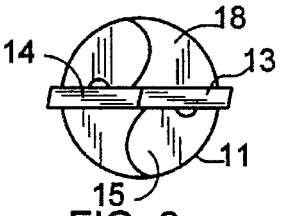
FIG. 6 is a top view of the drill bit insert affixed within a transverse slot of a drill body.

Referring to FIG. 1 wherein a masonry drill bit 10 of the present invention is displayed, the masonry drill bit of the present invention is comprised of a cylindrical drill body 11, shank 17, and a hardened drill bit insert 20 inserted into a transverse slot 26 located at the working end of said drill body, as seen in FIG. 5. The drill body 11 is made of standard steel material which is generally much softer than the hardened carbide drill bit insert 20. The drill body 11 has at least one discharge spiral groove 15 which extends downward along its length to the shank 17. The spiral groove 15 does not extend into smooth shank portion 17 opposite the working end so that the shank 17 may be inserted into the receiving end of an appropriate drill. The axial drill body 11 may advantageously have a second spiral groove 18, shown in FIG. 6, which extends downward from the working end of the drill body opposite said first spiral groove 15. Two spiral grooves may be required when there are two distinct cutting edges located on the drill bit insert. These spiral grooves allow for ready discharge of the drilled material which the hardened drill bit insert 20 is cutting and moves this debris from the cutting edges away from the material drilled so that said debris does not interfere with the cutting action of the bit.

The cylindrical drill body 11 has at its working end a transverse slot 26 shown in FIG. 5. The slot 26 is formed by milling and allows for the insertion of drill bit insert 20. The transverse slot 26 is of such width as to allow for a snug fit of the drill bit insert 20 into slot 26. Slot 26 has smooth channel side walls 27 and 28 so the drill bit insert 20 may readily slide into slot 26. Axial drill body 11 and shank 17 is constructed of solid material, such as steel, which is malleable enough to allow for the proper insertion of the hardened drill bit insert 20 into slot 26 while still providing enough resistance to firmly engage said insert. Drill bit insert 20 is pressed into slot 26 using a press, said force sufficient enough to insert the carbide insert fully into the slot and allow the rib or projection members 21 and 22, shown in FIG. 2A, to engage side wall 28 of the transverse slot 26 and member 23 and 24 to engage side wall 27. Rib members 21, 22, 23, and 24, being made of the hardened carbide material, score side walls 27 and 28 when properly inserted. This scoring of the side wall faces ensures the snug fit of the drill bit insert into the slot so that the insert may be subsequently properly affixed thereto by thorough brazing.

Transverse slot 26 has a base portion **26*a* which may not be fully perpendicular to side walls 27 and 28. Base portion 26*a* is formed, as described above, by a milling process. However, base portion 26*a* is formed within drill body 11 so that it is made with a slight indentation or curvature extending downward towards shank 17 beyond the bottom edge of side walls 27 and 28. Thus, when the drill bit insert 20 is forced within slot 26, there exists directly below insert 20 a small space formed by said indentation or curvature within which the drill bit insert does not extend into. This space allows for braze material to flow between projections 21 and 22 on first planar face 29, and projections 23 and 24 on second planar face 30. Additionally, the braze material may flow below drill bit insert 20 thereby fully surrounding the drill bit insert pressed within slot 26** securely affixing the insert within said slot.

The drill bit insert 20 is made of a hardened material which is resistant to wear. The preferred material used in forming the insert is tungsten carbide. This material is preferred because it is hardened and resistant to wear as well as receptive to brazing.

Figure 2:
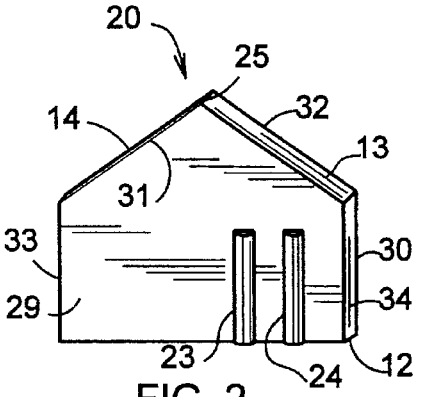
FIG. 2 is a perspective view of the planar surface of the hardened drill bit insert of the present invention having two projections on each planar surface.
Figure 3:
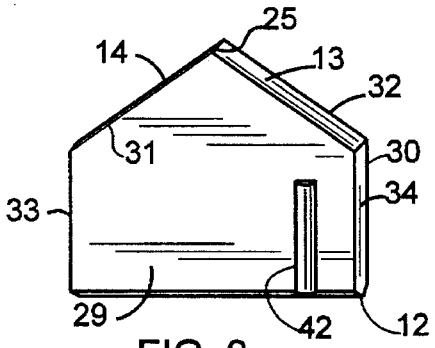
FIG. 3 is a perspective view of the planar surface of an alternative hardened drill bit insert of the present invention having one projection on each planar surface.

The hardened drill bit insert 20 of FIG. 2 and FIG. 3 is formed with first and second parallel planar surfaces 29 and 30, first and second side faces 33 and 34, a crowned tip 25 from which cutting edges 32 and 31 extend on opposite sides downward therefrom. First and second upper surfaces 13 and 14 extend from crowned tip 25 to first and second sides faces 34 and 33. First and second upper surfaces 13 and 14 have a front cutting edge and a back trailing edge. The cutting edge is that leading edge of the insert when the bit rotates in a clockwise rotation as shown. On first upper surface 13, front cutting edge 32 is formed along the edge defined by first upper surface 13 and planar surface 30. The edge formed by first upper surface 13 and planar surface 29 forms the back edge of first upper surface 13. On second upper surface 14, front cutting edge 31 is formed along the edge defined by second upper surface 14 and planar surface 29. The opposite edge formed along second upper surface 14 is the back edge of second upper surface 14.

Figure 8:
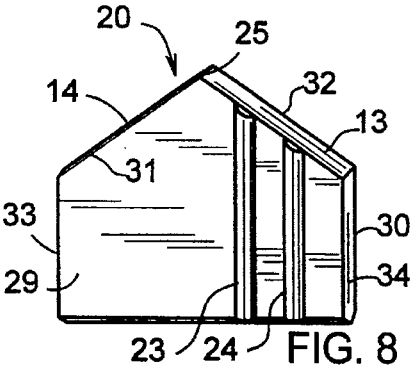
Figure 7:
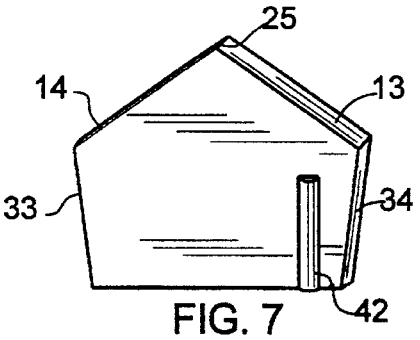
FIG. 7 is a frontal view of a hardened drill bit insert with slight axial relief; and, FIG. 8 is a modification of the insert shown in FIG. 2 with projections extending the full length of each planar surface.

As seen in FIG. 3 and FIG. 8, bottom surface 12 of drill bit insert 20 may have slightly bevelled edges. Bevelling of the edges allows for easy insertion of drill bit insert 20 into slot 26. The bottom surface 12 of the drill bit may be bevelled when transverse slot 26 has a base portion **26*a* which does not have a curvature as shown in FIG. 5. If the slot base 26*a* is perpendicular to slot walls 27 and 28, bevelled base 12 allows the braze material to flow between the ribs, when two ribs are utilized, and prevents air pockets from forming thereby causing a solid braze fill for the entire length of the rib members. When a curved base 26*a* is utilized as shown in FIG. 5**, no bevelling of the base is required.

Cutting edges 31 and 32 extend along the leading rotating edges of the bit downward on opposite sides from said crown tip 25 to the first and second side edges 34 and 33 and are created by making second planar face 30 and first planar face 29 non-perpendicular with side faces 33 and 34, forming radial relief preferably by about 5 degrees, thus causing first upper surface 13 to recede slightly from the cutting edge 32 to planar surface 30. By providing for a cutting edge with radial relief as described, the drill bit is allowed to better cut into the masonry material which is subjected to drilling. Side faces 33 and 34 may also have slight axial relief, about 1 degree, thereby increasing the cutting action of edges 32 and 31 and avoid side edge dragging in hole being bored.

Figure 2A:
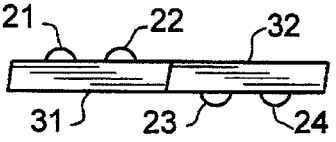
FIG. 2A is a top view of the drill bit insert of FIG. 2.

The masonry drill bit shown is designed to be a clockwise rotating drill bit, from the perspective of the shank end, with the projections or ribs formed on the trailing face opposite the leading cutting edge. As shown in FIG. 2, with the drill bit rotating in a clockwise fashion, leading cutting edge 32 has no ribs or projections formed therebelow on half of the planar surface 30 directly below the cutting edge 32. There are however, formed on planar surface 30, ribs or projections formed on the other half portion of surface 30 which trails cutting edge 31. This same design is mirrored on planar surface 29, where ribs 23 and 24 are formed below upper surface 13 but not below upper surface 14, as shown in FIG. 2A.

Figure 4:
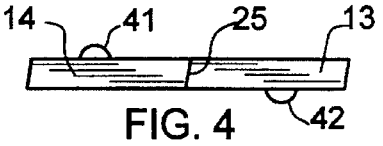
FIG. 4 is a top view of the hardened drill bit insert of FIG. 3.

On each of said front and back planar surfaces 29 and 30 of the hardened drill bit insert are located projections or ribs, 21 and 22, shown in FIG. 2, extending outward therefrom on the trailing face as disclosed above. The projections 21, 22, 23 and 24 in FIG. 2A, and 41 and 42 in FIG. 3 and FIG. 4, extend outward from planar surface 29 and 30 enough to orient and retain the drill bit insert in place within slot 26 for brazing. One or more projections may be provided for on each surface so long as each of said projections allow the drill bit to be inserted within slot 26 and orient the drill bit 20 for proper subsequent brazing. To be properly held into place within axial drill body 11, drill bit insert 20 must be properly and securely brazed. Projections 41 and 42 orient the insert 20 within the slot 26 and allow brazed material to fully surround the drill bit 20 thereby securely affixing the insert into slot 26. Preferably, projections 41 and 42 extend about 0.008 inch from each planar surface thereby providing clearance between slot walls 27 and 28 and drill bit 20 of about 0.003 inch. The location of projections 21, 22, 23 and 24 are situated so as to prevent said projections from interfering with the cutting action of the cutting edges 31 and 32 as it rotates clockwise about the bits central axis.

As shown in FIG. 3, a single projection 41 and 42 may be located on each planar surface 29 and 30 and positioned on the half side opposite said cutting edges. Thus, formed upon the drill bit of the present invention, are at least one projection on each planar surface. The projections are formed on each planar surface 29 and 30 as an integral part of the insert during the pressing operation. The drill bit projections extend roughly one half (½) the vertical distance of planar surface 29 and 30, extending vertically between the bottom surface 12 of the drill bit and the cutting edge of the respective upper surfaces. The short length of the ribs allow the braze material to flow easily through and around the ribs to the base **26*a* of slot 26. Slot base 26*a* is angled or curved somewhat to allow the braze material to flow through the space between the two ribs, shown in FIG. 2, and prevent air pockets from developing within said area. If longer ribs or projections are utilized to more securely hold the drill bit insert 20 within the transverse slot 26, as shown in FIG. 8**, a thinner braze material may be used to ensure adequate fluidity and movement of the braze within and around the projections.

The projections have a width of preferably about 0.03 inch on a one-quarter inch drill bit and 0.06 inch on a one-half inch drill bit thus providing sufficient contact surface against transverse slot side walls 27 and 28, of FIG. 5, to secure the drill bit within the slot. The projections, when the drill bit insert is inserted within slot 26, slightly deform the side walls 27 and 28 causing corresponding indentions to be formed on the side walls. The deformation however is slight and the insert 20 must still be brazed within the slot for proper securing.

The width and outward extension of the projections must be sufficient to allow braze material, preferably a copper silver alloy, to flow into transverse slot 26 and surround the drill bit effectively brazing the drill bit 20 into the working end of the axial drill body 11. Preferentially, a clearance of 0.003 inch is provided for the brazing material to flow into the openings created thereby providing for proper braze coverage and keeping shrinkage porosity to a minimum. The difference between the clearance provided between insert 20 and slot walls 27 and 28 and the actual outward distance of projections 21 and 24 (0.003 inch compared to 0.008 inch) is caused by the slight deformation of the said walls caused when the insert is inserted into the slot. Braze fill thickness preferentially fills the entire gap between the insert 20 and slot walls 27 and 28 and below the inserted carbide insert within the channel or slot, from a maximum of 0.008 inch to a minimum of 0.003 inch.

In practice, the hardened drill bit insert 20 of the present invention having projections 21, 22, 23, and 24, is forcibly inserted into channelled slot 26 located at the working end of axial drill body 11. The projections cause transverse slot side walls 27 and 28 to slightly deform laterally and thereby hold the insert into place by tension. Once held into place, the drill bit insert is brazed within transverse slot using a copper alloy braze material, said material of sufficient quality and fluidity to flow around and below the drill bit insert and secure said insert within said slot. The braze material must be solid enough to allow for repeated use of the masonry drill bit without cracking or wear of the braze thus causing the drill bit insert 20 to come loose from slot 26. The brazed joint formed exhibits excellent fill and thickness. Preferably, joint thickness for the braze of the present invention is kept below 0.01 inch thus providing for good braze flow and reduction in shrinkage porosity.

Preferentially, the hardened drill bit insert 20 of the present invention has one or more ribs on each planar surface providing a total rib or projection count of at least two. Utilizing at least two ribs on each planar surface as shown in FIG. 2 causes the carbide insert, upon insertion, to be kept at a proper orientation within slot 26 and prevents the insert from becoming skewed within said slot. By providing for proper orientation within the transverse slot of the axial drill body, the insert may be properly brazed into place allowing for thorough braze coverage, minimizing shrinkage porosity and creating appropriate joint thickness and increased overall strength of the braze. Proper orientation of drill bit insert 20 also increases the cutting effectiveness of the cutting edges 32 and 31.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. A masonry drill bit, comprising:

(a) an elongated cylindrical drill body having at one distal end a transverse slot extending thereacross and a shank at the opposite distal end, said drill body having at least one spiral groove formed along its exterior surface from said transverse slot to said shank;

(b) a drill bit insert brazed within said transverse slot, said insert having:

(1) a bottom surface;

(2) a first and second planar surface;

(3) a first and second side face connecting said first and second planar surfaces;

(4) a leading crown tip forming a first and a second upper surface extending downward from said crown tip to said first and second side faces;

(5) a first and a second cutting edge formed along opposite sides of said first and second upper surfaces;

(6) at least one projection extending vertically on each of said first and said second planar surface wherein said first and second cutting edge do not have a projection formed on the planar surface directly thereunder, said at least one projection causing a clearance between said insert and said transverse slot; and, (7) a braze fill in said clearance between said insert and said transverse slot.

2. The drill bit insert of claim 1 wherein said at least one projection extends vertically halfway from said bottom surface towards said first and said second upper surface.

3. The drill bit of claim 1 wherein said drill bit insert has at least two projections located on each of said first and second planar surface.

4. The drill bit of claim 1 wherein said drill body has two spiral grooves extending downward from said transverse slot to said shank.

5. The drill bit of claim 1 wherein said carbide insert is made of tungsten carbide.

6. The drill bit of claim 1 wherein said drill body is made of steel.

7. The drill bit of claim 1 wherein said braze fill is of a copper silver alloy material.

8. The drill bit insert of claim 1 wherein said two side faces connecting said first and second planar surfaces form a skewed angle with said first and second planar surfaces differing from a right angle by about 5 degrees.

9. The drill bit insert of claim 1 wherein said bottom surface has bevelled edges.

10. The drill bit of claim 1 wherein said transverse slot has a first and a second side wall and a base portion, said base portion in non-perpendicular relationship with said first and said second side walls.

11. The masonry drill bit insert of claim 1 wherein said projections extend outward an equal distance from said planar surfaces for their entire length.

12. The drill bit insert of claim 1, wherein said at least one projection extends vertically from said bottom surface to said respective first and said second upper surface.

13. A method of making a masonry drill bit comprising the steps of:

(a) forming an elongated drill body of steel material, said body having a shank at one end and a transverse slot for receiving a hardened drill bit insert at the opposite distal end of said shank, said body having at least one spiral groove extending downward from said transverse slot to said shank;

(b) inserting a hardened drill bit insert into said transverse slot, said drill bit insert having two flat planar surfaces, two side faces connecting said two flat planar surfaces such that said side faces are slightly skewed with respect to said two planar surfaces, a leading crown tip forming two upper surfaces extending downward from said crown tip to said two side faces, two cutting edges formed along opposing sides of said two upper surfaces, at least one rib located on each of said two planar surfaces, said ribs extending vertically downward only along the opposite planar surface where said cutting edge is formed and projecting outward from said planar surface an equal distance for the entire length of said ribs, said at least one rib causing a clearance between said insert and said transverse slot;

(c) brazing said drill bit insert into said transverse slot with a solid braze fill in said clearance between said insert and said transverse slot securely affixing said insert within said transverse slot.

* * * * *